US009586406B2

(12) United States Patent
Yamasaki

(10) Patent No.: US 9,586,406 B2
(45) Date of Patent: Mar. 7, 2017

(54) LIQUID STORING BODY HAVING MULTIPLE INFLOW PORTS

(71) Applicant: Seiko Epson Corporation, Tokyo (JP)

(72) Inventor: Keigo Yamasaki, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/058,608

(22) Filed: Mar. 2, 2016

(65) Prior Publication Data

US 2016/0257124 A1 Sep. 8, 2016

(30) Foreign Application Priority Data

Mar. 3, 2015 (JP) ..... 2015-041019

(51) Int. Cl.
*B41J 2/175* (2006.01)

(52) U.S. Cl.
CPC ..... *B41J 2/17513* (2013.01); *B41J 2/17563* (2013.01); *B41J 2/17566* (2013.01); *B41J 2002/17516* (2013.01)

(58) Field of Classification Search
CPC ..... B41J 2/17513; B41J 2002/17516; B41J 2/17563; B41J 2/17566
See application file for complete search history.

(56) References Cited

U.S. PATENT DOCUMENTS

2004/0160496 A1 8/2004 Tsurui et al.
2005/0174396 A1* 8/2005 Nanjo ..... B41J 2/17513 347/85
2005/0270341 A1* 12/2005 Yamamoto ..... B41J 2/17513 347/85
2006/0146107 A1 7/2006 Tsurui et al.
2009/0015642 A1* 1/2009 Nozawa ..... B41J 2/17509 347/86
2010/0188467 A1* 7/2010 Hyakudome ..... B41J 2/175 347/85

FOREIGN PATENT DOCUMENTS

JP 2001-270131 A 10/2001
JP 2005-007855 A 1/2005
JP 2005-342993 A 12/2005

* cited by examiner

*Primary Examiner* — Bradley Thies

(74) *Attorney, Agent, or Firm* — Harness, Dickey & Pierce, P.L.C.

(57) ABSTRACT

Provided is a liquid storing body that makes it possible to prevent a liquid containing a sedimentous component whose concentration is higher than a proper range from being supplied to a liquid jetting apparatus. An ink pack 1 is provided with a flexible ink storage bag 2 capable of storing pigment ink containing a sedimentous component, an ink supply part 3 provided at an upper portion of the ink storage bag 2, and a flow path member 4 that connects the interior of the ink storage bag 2 and the ink supply part 3. The flow path member 4 is provided with a vertical tube part 41 extending downward from the ink supply part 3, a lateral tube part 42 extending horizontally from the lower end of the vertical tube part 41, and a vertical tube part 43 extending upward from the end of the lateral tube part 42.

7 Claims, 4 Drawing Sheets

LIQUID STORING BODY HAVING MULTIPLE INFLOW PORTS

CROSS-REFERENCE TO RELATED APPLICATION

The entire disclosure of Japanese Patent Application No. 2015-041019, filed Mar. 3, 2015 is expressly incorporated by reference herein.

BACKGROUND

1. Technical Field

The present invention relates to a liquid storing body for supplying a liquid containing a sedimentous component such as pigment to a liquid jetting apparatus.

2. Related Art

Inkjet printers (liquid jetting apparatus) that use pigment ink (liquid) are known. In pigment ink, pigment is dispersed as particles in a solvent, and therefore if an ink tank or an ink pack (liquid storing body) storing the pigment ink is left for a long period of time, the pigment settles in the ink tank or the ink pack. As a result, the concentration of the pigment in the ink tank or the ink pack varies depending on the height, leading to a nonuniform concentration state.

If the concentration is not uniform in the ink tank or the ink pack, there is a risk that high-concentration ink with a pigment concentration that is higher than in the uniform concentration state is supplied to the inkjet printer. If the high-concentration ink is supplied to the inkjet printer, print density is increased, and deterioration of image quality occurs, in some cases. In addition, because an increase in pigment concentration increases the viscosity of the pigment ink, if the high-concentration ink is supplied to the inkjet printer, clogging or the like easily occurs in the ink nozzle of the inkjet head.

In JP-A-2005-7855, a tubular ink stirring chamber is provided in an ink tank that is mounted to an inkjet printer. The ink stirring chamber extends upward from the bottom portion of the ink tank, and liquid inflow ports are formed at a plurality of positions at different heights. In the case where the concentration varies depending on the height in the ink tank, ink of different densities flows into the ink stirring chamber from the plurality of liquid inflow ports that are positioned at different heights. As a result, pigment ink with different concentrations undergoes convection and becomes mixed in the ink stirring chamber, and is supplied to the inkjet printer. Therefore, even in the case where the concentration is nonuniform in the ink tank, it is possible to avoid the supply of pigment ink with a predetermined concentration or higher to the inkjet printer.

An ink supply port (liquid supply port) for supplying ink to the inkjet printer is provided in the ink tank or the ink pack. In JP-A-2005-7855, the ink supply port is provided in the bottom portion of the ink tank, and the lower end of the ink stirring chamber is connected to the ink supply port. Here, in the case of applying the structure of JP-A-2005-7855 to an ink tank or an ink pack having the ink supply port provided in the upper portion thereof, there is a risk that the convection of ink in the ink stirring chamber is insufficient, and high-concentration ink and low-concentration ink are supplied without being sufficiently mixed.

For example, in the case where printing in a small amount and stopping printing are repeatedly performed, low-concentration ink flows into the ink stirring chamber at the upper portion thereof from the liquid inflow ports, and is supplied from the upper end of the ink stirring chamber to the ink supply port without being sufficiently mixed with high-concentration ink that flows into the ink stirring chamber at the lower portion thereof from the liquid inflow ports. At the lower portion of the ink stirring chamber, most of the pigment settles again, because the printing is stopped before the high-concentration ink undergoes convection and becomes mixed with the low-concentration ink at the upper portion of the ink stirring chamber. As a result, when the ink in the ink tank or the ink pack becomes low, there are risks that the high-concentration ink is supplied to the inkjet printer, and deterioration of printing quality, ink nozzle clogging and the like occur.

SUMMARY

An advantage of some aspects of the invention is to provide a liquid storing body that can supply a liquid containing a sedimentous component of a concentration within a predetermined range regardless of the passage of time, to a liquid jetting apparatus via a liquid supply port that is provided in the upper portion of the liquid storing body.

In order to solve the above-described problem, a liquid storing body according to an aspect of the invention includes: a liquid storing part that is capable of storing a liquid containing a sedimentous component; a liquid supply part that is positioned at an upper portion of the liquid storing part, and is capable of supplying the liquid from the liquid storing part to a liquid jetting apparatus; and a flow path that connects the liquid supply part and the interior of the liquid storing part, wherein the flow path includes a plurality of liquid inflow ports at a plurality of positions at different heights, the plurality of liquid inflow ports allowing the liquid to flow from the interior of the liquid storing part into the flow path, and out of the plurality of liquid inflow ports, a first liquid inflow port positioned at the lowest position in the flow path is arranged on the downstream side of the other liquid inflow ports in a flow of the liquid toward the liquid supply part.

According to this aspect of the invention, the first liquid inflow port positioned at the lowest position is the liquid inflow port into which high-concentration liquid flows, and this liquid inflow port is arranged at the most downstream position that is nearest to the liquid supply part. Therefore, the high-concentration liquid is reliably mixed with low-concentration liquid that is taken in from the other liquid inflow ports when the liquid is supplied to the liquid supply part. Accordingly, even if the concentration of the liquid becomes nonuniform due to the passage of time, the concentration of the liquid that is supplied to the liquid supply part can be prevented from significantly differing from the concentration of the liquid that is supplied in a state in which nonuniformity of concentration is small. Thereby, liquid with a concentration within a predetermined concentration range can be supplied to the liquid jetting apparatus regardless of the passage of time. Accordingly, it is possible to avoid the occurrence of deterioration of printing quality, ink nozzle clogging and the like.

According to another aspect of the invention, it is desirable that the flow path includes a first flow path part extending in an up-down direction from the liquid supply part to the lowest position in the flow path, a second flow path part extending in a direction intersecting the first flow path part from a lower portion of the first flow path part, and a third flow path part extending upward from the second flow path part. Thereby, if the first liquid inflow port is formed at a low position in the third flow path part, it is possible to easily achieve the state in which the first liquid inflow port is positioned at the lowest position in the flow path, and is arranged most downstream.

According to another aspect of the invention, it is desirable that the first flow path part extends to a position lower than a position that intersects the second flow path part. With such a configuration, the first liquid inflow port can be arranged at a position that is reliably lower than the second flow path part and the third flow path part (the lowest portion of the first flow path part). Therefore, a structure can be realized in which high-concentration liquid that flowed in from the lowest portion of the first flow path part and low-concentration liquid that flowed into the first flow path part via the second flow path part are easily mixed.

According to another aspect of the invention, it is desirable that the third flow path part includes a plurality of flow paths extending upward from the second flow path part, and the upper ends of the plurality of flow paths are positioned at different heights, and the liquid inflow ports are respectively provided at the upper ends of the plurality of flow paths. With such a configuration, the liquid inflow ports can be provided at a plurality of positions at different heights without forming openings such as through holes midway in the flow paths. Therefore, the flow paths can be formed easily.

In the invention, it is desirable that the liquid storing body includes: a case in which a recess that constitutes the liquid storing part and the flow path is formed; and a film that seals an opening of the recess, wherein the liquid storing part and the flow path are partitioned by a partition wall arranged in the recess. With such a configuration, when manufacturing the liquid storing part, a flow path can also be integrally formed at the same time. Therefore, the liquid storing body is easily manufactured.

BRIEF DESCRIPTION OF THE DRAWINGS

The invention will be described with reference to the accompanying drawings, wherein like numbers reference like elements.

DESCRIPTION OF EXEMPLARY EMBODIMENTS

An ink pack and an ink tank (liquid storing body), which are embodiments of the invention, will be described below with reference to the drawings.

First Embodiment

Figure 1:
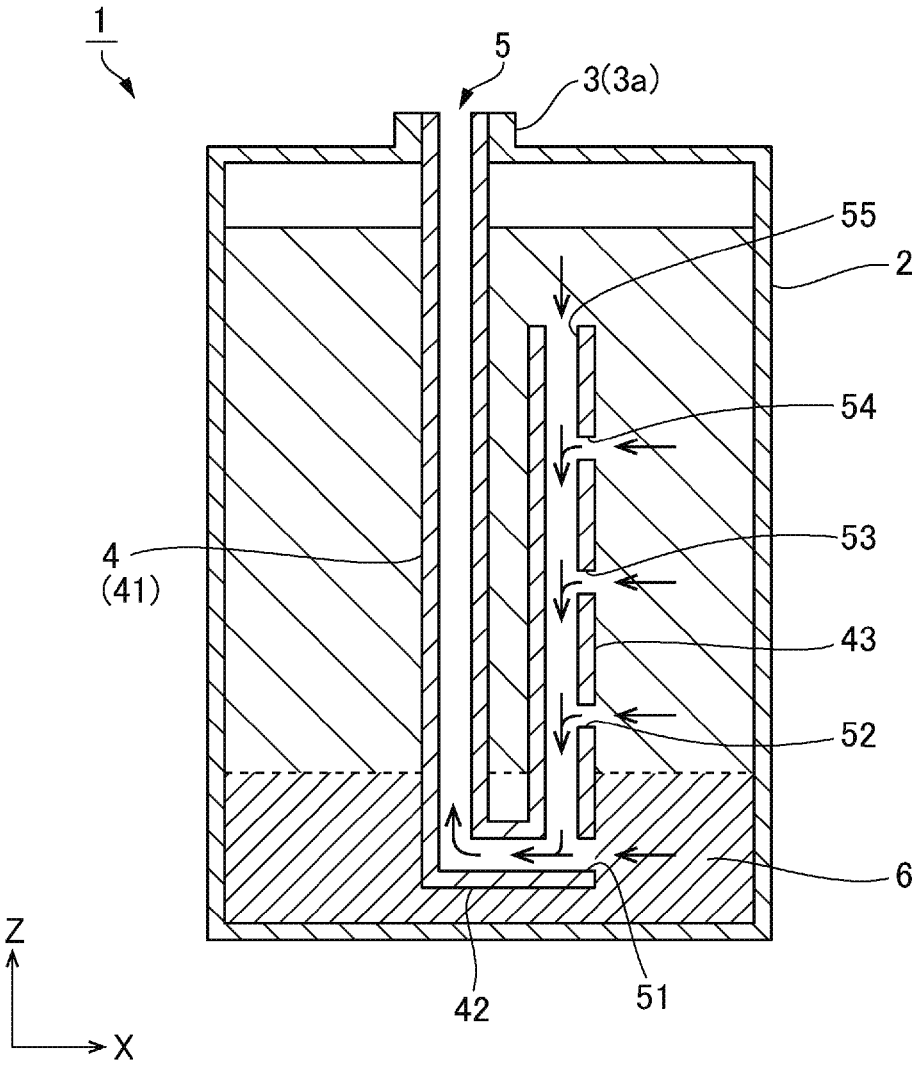
FIG. 1 is an explanatory view of an ink pack of a first embodiment to which the invention is applied.

FIG. 1 is an explanatory view schematically showing an ink pack of a first embodiment to which the invention is applied. An ink pack 1 (liquid storing body) of the first embodiment is installed in an inkjet printer (liquid jetting apparatus) provided with an inkjet head (printing head) and supplies pigment ink to the inkjet head.

The ink pack 1 is provided with an ink storage bag 2 (liquid storing part) capable of storing the pigment ink, an ink supply part 3 (liquid supply part) to which an ink supply flow path (not illustrated) on the inkjet printer side is connected, and a flow path member 4 (flow path) that connects the interior of the ink storage bag 2 and the ink supply part 3. As shown in FIG. 1, when the ink pack 1 is installed in the inkjet printer, the ink pack 1 is mounted in a posture in which the ink supply part 3 is positioned at the upper end of the ink storage bag 2 in the vertical direction Z.

Two directions X and Z shown in FIG. 1 are directions that are orthogonal to each other, and the direction X is the width direction of the ink storage bag 2, and the direction Z is the vertical direction. Regarding the two directions X and Z, the direction of an arrow indicates the + direction (positive direction), and the direction opposite to the direction of the arrow indicates the − direction (negative direction). Moreover, a +Z direction indicates the upward side of the vertical direction, and a −Z direction indicates the downward side of the vertical direction.

The ink storage bag 2 is formed in a bag shape by arranging two flexible films so as to be layered on each other in a direction orthogonal to the two directions X and Z (a direction perpendicular to the paper face in which FIG. 1 is shown), and joining together the two end edges thereof in the width direction X and the lower end edges by heat welding. The films constituting the ink storage bag 2 are made of polyethylene terephthalate, nylon, polyethylene or the like. A film having a multilayer structure in which a plurality of films are laminated can be used as this film. A film having a multilayer structure in which an aluminium film is arranged as an intermediate layer can also be used.

The ink supply part 3 is provided with a joint part (not illustrated) extending along the upper end edge of the ink storage bag 2 in the width direction X, and a tube part 3*a* extending in the +Z direction (upward) from approximately the center of the joint part in the width direction X, for example. The ink supply part 3 is formed of a resin that can be heat-welded to the ink storage bag 2. The joint part is sandwiched by the two films at the upper end of the ink storage bag 2, and joined to the ink storage bag 2 by heat welding. A through hole that passes through the tube part 3*a* is formed in the ink supply part 3, and this through hole is an ink supply port 5 that puts the interior and exterior of the ink storage bag 2 into communication. In the ink storage bag 2, the upper end of the flow path member 4 is connected to the ink supply port 5. In addition, the upstream end of the ink supply flow path on the inkjet head side is connected to the upper end of the ink supply port 5. Therefore, ink in the ink storage bag 2 can be supplied from the ink supply port 5 to the inkjet head.

The flow path member 4 is a tubular member. The flow path member 4 is provided with a vertical tube part 41 (first flow path part) extending inside the ink storage bag 2 in the vertical direction Z (up-down direction), a lateral tube part 42 (second flow path part) extending from the lower end of the vertical tube part 41 in the width direction X, and a vertical tube part 43 (third flow path part) extending in the +Z direction (upward) from the end of the lateral tube part 42 in a +X direction. The upper end of the vertical tube part 41 is a connection part for connection to the ink supply port 5.

The flow path member 4 is provided with a plurality of liquid inflow ports that are formed at positions at different heights. Specifically, the flow path member 4 is provided with a first liquid inflow port 51 formed at a corner portion at which the lateral tube part 42 and the vertical tube part 43 are connected; a second liquid inflow port 52, a third liquid inflow port 53, and a fourth liquid inflow port 54 that are formed in the tube wall of the vertical tube part 43; and a fifth liquid inflow port 55 that is open at the upper end of the vertical tube part 43. The first liquid inflow port 51 to the fourth liquid inflow port 54 are arranged with a constant interval in the vertical direction Z.

Pigment ink in the ink storage bag 2 is supplied from the ink supply part 3 to the inkjet head side through the interior of the flow path member 4. At this time, the pigment ink flows through the flow path member 4 in the order of the vertical tube part 43, the lateral tube part 42, and then the vertical tube part 41. That is, the vertical tube part 41 side is the downstream side, and the vertical tube part 43 side is the upstream side. The pigment ink flowing through the flow path member 4 is pigment ink taken into the vertical tube part 43 from the fifth liquid inflow port 55, and joins and is mixed with pigment ink taken in from the fourth liquid inflow port 54. Subsequently, the pigment ink joins and is mixed with pigment ink taken in from the third liquid inflow port 53, then further joins and is mixed with pigment ink taken in from the second liquid inflow port 52, lastly joins and is mixed with pigment ink taken in from the first liquid inflow port 51, passes through the lateral tube part 42 and the vertical tube part 41, and is supplied from the ink supply port 5 to the inkjet head side.

As described above, out of the first liquid inflow port 51 to the fifth liquid inflow port 55 that are included in the flow path member 4, the port that is arranged most downstream in the flow of the pigment ink flowing toward the ink supply part 3 is the first liquid inflow port 51. This first liquid inflow port 51 is positioned at the lowest position in the ink flow path constituted by the flow path member 4, and is arranged at a position lower than the other liquid inflow ports (the second liquid inflow port 52 to the fifth liquid inflow port 55).

When a long period of time passes without printing being performed, the pigment component settles, leading to a state in which the pigment concentration varies depending on the height. Even in such a state, the pigment ink is taken into the flow path member 4 of the first embodiment from each of the first liquid inflow port 51 to the fifth liquid inflow port 55 that are formed at different heights, and thus ink of different densities is mixed in the flow path member 4. Therefore, it is possible to suppress the variation in concentration of the ink supplied from the ink supply part 3 to the inkjet head caused by the passage of time.

In addition, the concentration of the pigment ink that is supplied to the inkjet head has a proper range, and pigment ink in the state in which there is no concentration difference due to sedimentation of a pigment component has a pigment concentration that is within the proper range. On the other hand, if the pigment component settles, a high-concentration ink layer 6 in which ink of a pigment concentration that exceeds the proper range is accumulated is formed at the bottom portion of the ink storage bag 2. In the first embodiment, the portion positioned at the lowest position in the flow path member 4 (the lateral tube part 42) is positioned in the high-concentration ink layer 6, and the first liquid inflow port 51 arranged most downstream in the flow of the pigment ink flowing toward the ink supply part 3 is positioned in the high-concentration ink layer 6.

If the first liquid inflow port 51 that allows the pigment ink to be taken in at the most downstream portion is positioned in the high-concentration ink layer 6 in this manner, ink with the highest concentration is added to the pigment ink flowing toward the ink supply part 3 at the final stage of the procedure in which the ink with different concentrations is sequentially mixed. Therefore, the high-concentration ink is reliably mixed with the pigment ink flowing toward the ink supply part 3. Because no liquid inflow port is formed on the downstream side of the first liquid inflow port 51, the ink concentration does not decrease due to low-concentration ink that would be taken in between the first liquid inflow port 51 and the ink supply part 3. Accordingly, even if a concentration difference due to sedimentation of the pigment component occurs in the ink storage bag 2, it is possible to avoid the supply of only low-concentration ink to the ink supply part 3. In particular, it is possible to avoid continuous supply of only the low-concentration ink, such as when printing in a small amount and stopping printing are repeated. Therefore, it is possible to avoid the occurrence of faulty image quality, ink nozzle clogging and the like due to the high-concentration ink having a pigment concentration that exceeds the proper range being supplied from the ink supply part 3 to the inkjet head when the ink residual amount becomes low.

Second Embodiment

Figure 2:
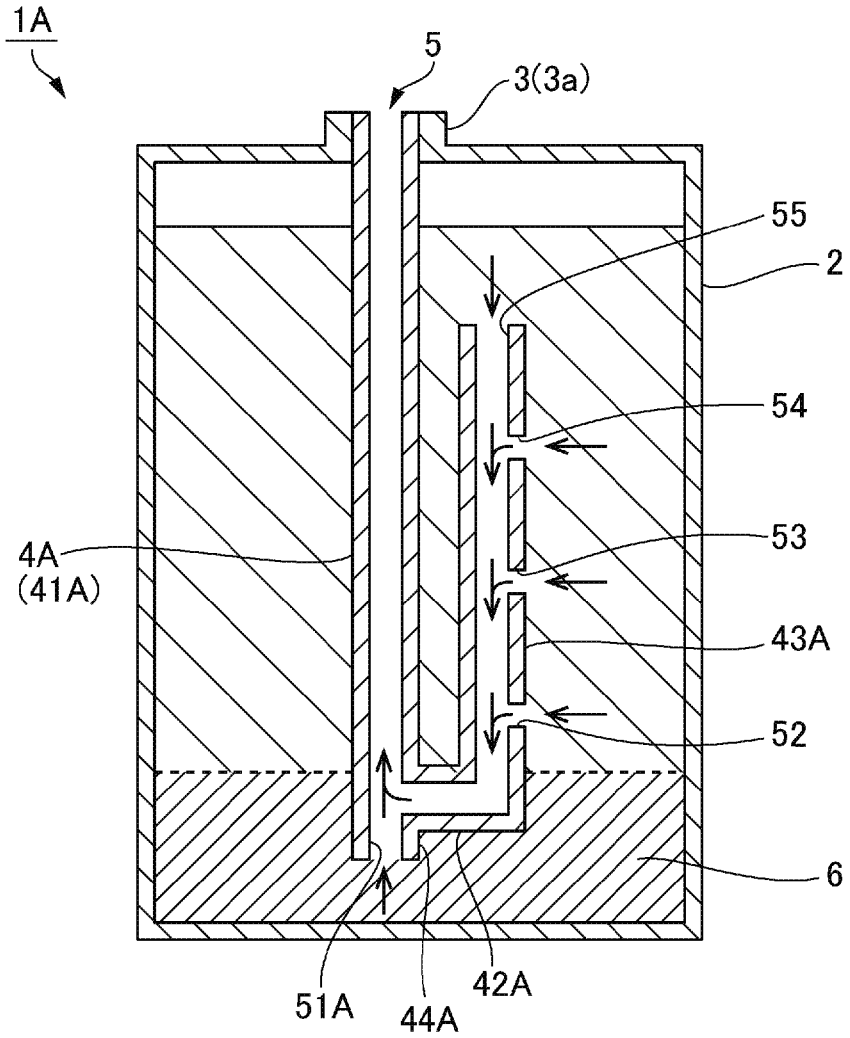
FIG. 2 is an explanatory view of an ink pack of a second embodiment to which the invention is applied.

FIG. 2 is an explanatory view schematically showing an ink pack of a second embodiment to which the invention is applied. The same reference signs are assigned to portions the same as in the first embodiment, thereby omitting description thereof, and different reference signs are assigned to only different portions and description thereof will be given below. An ink pack 1A (liquid storing body) of the second embodiment is provided with the ink storage bag 2 (liquid storing part), the ink supply part 3 (liquid supply part), and a flow path member 4A (flow path).

The flow path member 4A of the second embodiment is provided with a vertical tube part 41A (first flow path part), a lateral tube part 42A (second flow path part), and a vertical tube part 43A (third flow path part). The vertical tube part 41A is provided with a protruding tube part 44A extending downward below the position of connection to the lateral tube part 42A. A first liquid inflow port 51A is open at the lower end of the protruding tube part 44A. No liquid inflow port is formed at a corner portion at which the lateral tube part 42A and the vertical tube part 43A are linked, and the second liquid inflow port 52 to the fifth liquid inflow port 55 are formed in the vertical tube part 43A.

In the second embodiment, the first liquid inflow port 51A is arranged most downstream in a flow of pigment ink flowing toward the ink supply part 3. The first liquid inflow port 51A is also positioned at the lowest position in the ink flow path constituted by the flow path member 4A, and is arranged at a position lower than the other liquid inflow ports (the second liquid inflow port 52 to the fifth liquid inflow port 55). Therefore, in a state in which the pigment component has settled, the first liquid inflow port 51A is positioned in the high-concentration ink layer 6. With such a configuration, similarly to the first embodiment, high-concentration ink taken in from the first liquid inflow port 51A is reliably mixed with the pigment ink flowing toward the ink supply part 3. In addition, no low-concentration ink is taken in on the downstream side of the first liquid inflow port 51A. Therefore, it is possible to suppress variation in the concentration of the ink that is supplied to the inkjet head. It is also possible to avoid the occurrence of deterioration of printing quality, ink nozzle clogging and the like due to the high-concentration ink having a pigment concentration that exceeds the proper range being supplied from the ink supply part 3 to the inkjet head when the ink residual amount becomes low.

In particular, the flow path member 4A of the second embodiment allows the first liquid inflow port 51A to be arranged at a position reliably lower than the lateral tube part 42A, and ink to be taken in at a position nearer the bottom portion of the ink storage bag 2. Therefore, a state in which only high-concentration ink remains when the ink residual amount becomes low can be made less likely to occur. Note that in the first and second embodiments, four liquid inflow ports are provided on each of the vertical tube parts 43 and 43A, but three liquid inflow ports or fewer, or five liquid inflow ports or more may be provided.

Third Embodiment

Figure 3:
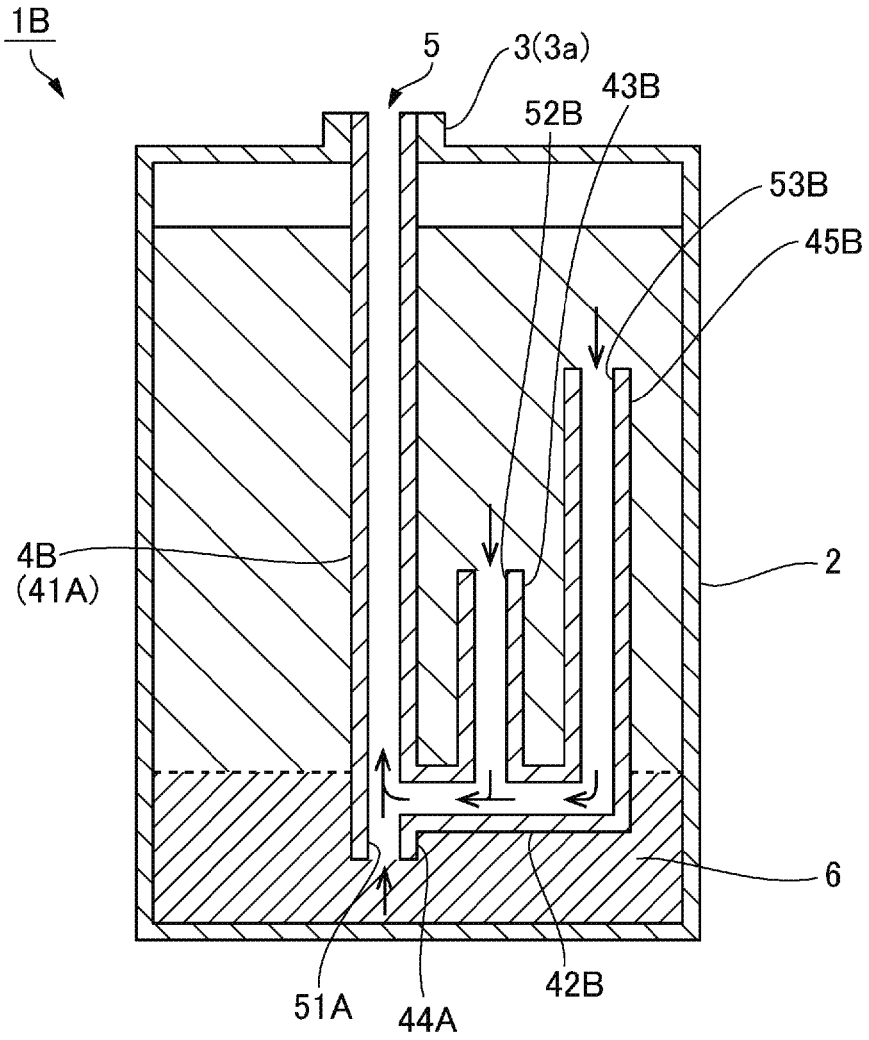
FIG. 3 is an explanatory view of an ink pack of a third embodiment to which the invention is applied.

FIG. 3 is an explanatory view schematically showing an ink pack of a third embodiment to which the invention is applied. The same reference signs are assigned to portions the same as in the first and second embodiments, thereby omitting description thereof, and different reference signs are assigned to only different portions and description thereof will be given below. An ink pack 1B (liquid storing body) of the third embodiment is provided with the ink storage bag 2 (liquid storing part), the ink supply part 3 (liquid supply part), and a flow path member 4B (flow path).

The flow path member 4B of the third embodiment is provided with the vertical tube part 41A (first flow path part), a lateral tube part 42B (second flow path part), a vertical tube part 43B (third flow path part), and a vertical tube part 45B (third flow path part). The vertical tube part 41A is provided with the protruding tube part 44A extending downward below the position of connection to the lateral tube part 42B, similarly to the second embodiment, and the first liquid inflow port 51A is open at the lower end of the protruding tube part 44A. The lateral tube part 42B is longer than the lateral tube part 42 of the first and second embodiments, has the vertical tube part 43B connected midway, and has the vertical tube part 45B connected to the end thereof on the side opposite to the vertical tube part 41A. The vertical tube part 43B and the vertical tube part 45B extend upward, and the upper ends thereof are at different heights. A second liquid inflow port 52B is open at the upper end of the vertical tube part 43B, and a third liquid inflow port 53B is open at the upper end of the vertical tube part 45B.

Pigment ink that flows through the flow path member 4B is pigment ink taken from the second liquid inflow port 52B into the vertical tube part 43B and pigment ink taken from the third liquid inflow port 53B into the vertical tube part 45B, both flowing into the lateral tube part 42B and joining each other. Lastly, the pigment ink joins and is mixed with pigment ink taken into the protruding tube part 44A from the first liquid inflow port 51A, passes through the vertical tube part 41A, and is supplied from the ink supply port 5 to the ink supply flow path.

In the third embodiment, the first liquid inflow port 51A is arranged most downstream in the flow of the pigment ink flowing toward the ink supply part 3. In addition, the first liquid inflow port 51A is positioned at the lowest position in the ink flow path constituted by the flow path member 4B, and is arranged at a position lower than the other liquid inflow ports (the second liquid inflow port 52B and the third liquid inflow port 53B). Therefore, in a state in which the pigment component has settled, the first liquid inflow port 51A is positioned in the high-concentration ink layer 6. Accordingly, similarly to the first and second embodiments, high-concentration ink taken in from the first liquid inflow port 51A is reliably mixed with the pigment ink flowing toward the ink supply part 3. In addition, no low-concentration ink is taken in on the downstream side of the first liquid inflow port 51A. Therefore, it is possible to suppress variation in the concentration of the ink that is supplied to the inkjet head. It is also possible to avoid the occurrence of deterioration of printing quality, ink nozzle clogging and the like due to the high-concentration ink having a pigment concentration that exceeds the proper range being supplied from the ink supply part 3 to the inkjet head when the ink residual amount becomes low.

In particular, the flow path member 4B of the third embodiment does not require openings to be formed in the side surfaces (tube walls) of tubular members constituting the flow path in order to form the liquid inflow ports, and therefore the flow path member 4B is easily manufactured. Note that in the mode shown in FIG. 3, only two vertical tube parts extending upward from the lateral tube part 42B are provided, but three vertical tube parts or more that are different in height may be provided.

Fourth Embodiment

Figure 4A:
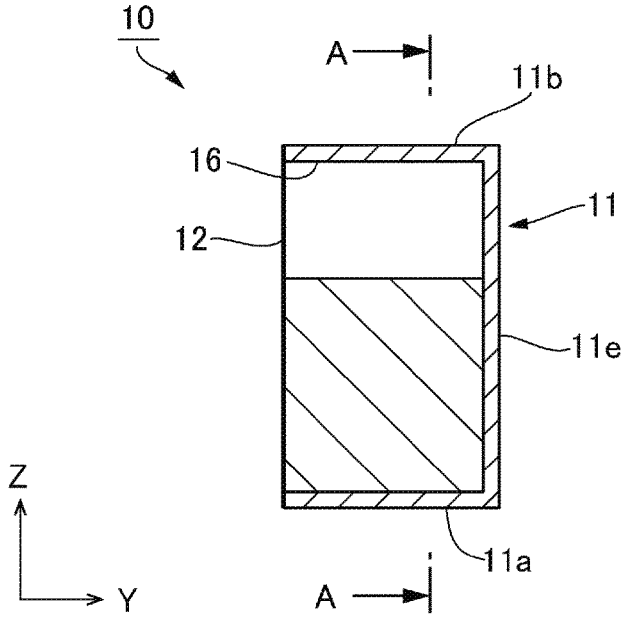
FIGS. 4A and 4B are explanatory views of an ink tank of a fourth embodiment to which the invention is applied.
Figure 4B:
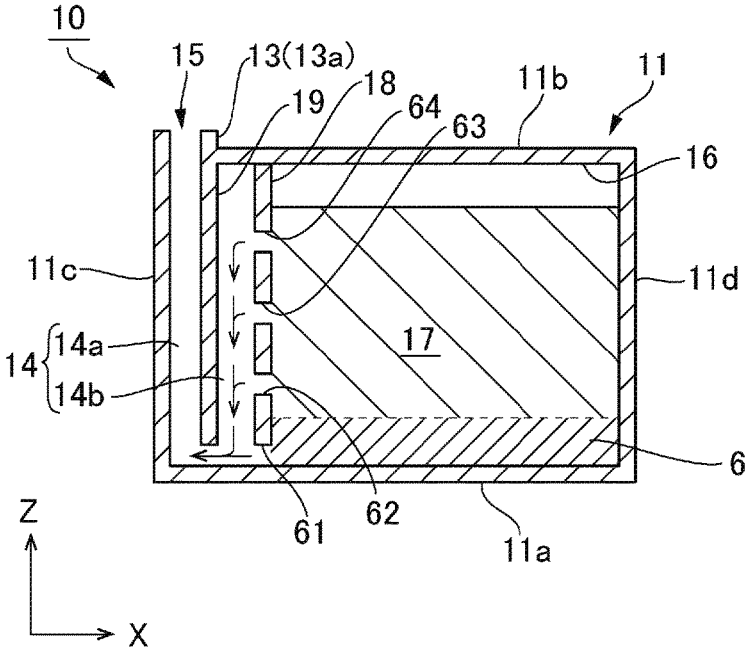

FIGS. 4A and 4B are explanatory views schematically showing an ink tank of a fourth embodiment to which the invention is applied. The first to third embodiments are obtained by applying the invention to the ink packs 1, 1A, and 1B provided with the flexible ink storage bag 2, but the fourth embodiment is obtained by applying the invention to an ink tank 10 provided with a resin case 11 whose side surface is open, and a flexible film 12 that seals the opening of the case 11. FIG. 4A is a cross-sectional view of the ink tank 10 taken along a surface perpendicular to the film 12, and FIG. 4B is a cross-sectional view of the ink tank 10 taken along a cross sectional line A-A in FIG. 4A.

Three directions X, Y and Z shown in FIG. 4 are directions that are orthogonal to one another, and the direction Z is the vertical direction. Regarding the three directions X, Y and Z, the direction of the arrow indicates the + direction (positive direction), and the direction opposite to the direction of the arrow indicates the − direction (negative direction). Moreover, a +Z direction indicates the upward side of the vertical direction, and a −Z direction indicates the downward side of the vertical direction.

The case 11 has a substantially rectangular parallelepiped shape, and is provided with a bottom wall 11*a* constituting the surface in the −Z direction, an upper wall 11*b* constituting the surface in the +Z direction, a side wall 11*c* constituting the surface in a −X direction, a side wall 11*d* constituting the surface in a +X direction, and a side wall 11*e* constituting the surface in a +Y direction. An ink supply part 13 (liquid supply part) is formed in the upper wall 11*b* of the case 11. The ink supply part 13 is provided with a cylindrical part 13*a* that protrudes upward from the upper wall 11*b*, and a through hole that passes through the cylindrical part is an ink supply port 15 that puts the exterior and the interior of the case 11 into communication. The upstream end of an ink supply flow path that communicates with the inkjet head is connected to the ink supply port 15. In addition, an air communicating port (not illustrated) is formed in the upper wall 11*b*.

As shown in FIG. 4A, the case 11 is provided with a recess 16 that is surrounded by five surfaces, that is, the bottom wall 11*a*, the upper wall 11*b*, the side wall 11*c*, the side wall 11*d* and the side wall 11*e*, and that is open in a −Y direction. The film 12 is formed of a synthetic resin (e.g., nylon or polypropylene), and is joined to the edge of the recess 16 by a joining method such as welding. As shown in FIG. 4B, the case 11 is provided with a partition wall 18 that partitions the recess 16 into a flow path space 14 (flow path) and an ink reservoir chamber 17 (liquid storing part). The partition wall 18 extends in the vertical direction Z, and the upper end thereof is connected to the upper wall 11*b*. The partition wall 18 is arranged at a position near the side wall 11*c* in the −X direction, and the flow path space 14 is formed between the partition wall 18 and the side wall 11*c*. The ink supply port 15 communicates with the upper end of the flow path space 14.

A first liquid inflow port 61, a second liquid inflow port 62, a third liquid inflow port 63, and a fourth liquid inflow port 64 that put the flow path space 14 and the ink reservoir chamber 17 into communication are formed in the partition wall 18. The first liquid inflow port 61 to the fourth liquid inflow port 64 are formed at positions at different heights. The first liquid inflow port 61 is a gap between the lower end of the partition wall 18 and the bottom wall 11*a*, and is positioned at the lowest position in the flow path space 14. The first liquid inflow port 61 to the fourth liquid inflow port 64 are aligned in this order from below to above.

A partition wall 19 extending downward from the upper wall 11*b* is provided in the flow path space 14. A gap in which ink flows is formed between the lower end of the partition wall 19 and the bottom wall 11*a*. The partition wall 19 is parallel to the partition wall 18. The flow path space 14 is provided with a first flow path space 14*a* formed between the side wall 11*c* and the partition wall 19, and a second flow path space 14*b* formed between the partition wall 19 and the partition wall 18. Pigment ink in the ink reservoir chamber 17 is supplied from the ink supply part 13 to the inkjet head side through the flow path space 14. At this time, the pigment ink flows through the flow path space 14 in the order of the second flow path space 14*b* and then the first flow path space 14*a*. The pigment ink that flows through the flow path space 14 is pigment ink taken into the second flow path space 14*b* from the fourth liquid inflow port 64 and pigment ink taken into the second flow path space 14*b* from the third liquid inflow port 63, which join and become mixed with each other. Subsequently, the pigment ink joins and is mixed with pigment ink taken in from the second liquid inflow port 62, lastly joins and is mixed with pigment ink taken in from the first liquid inflow port 61, passes through the first flow path space 14*a*, and is supplied from the ink supply port 15 to the inkjet head side.

As described above, in the fourth embodiment, out of the first liquid inflow port 61 to the fourth liquid inflow port 64 that put the flow path space 14 and the ink reservoir chamber 17 into communication, the port that is arranged most downstream in the flow of the pigment ink flowing toward the ink supply part 13 is the first liquid inflow port 61. This first liquid inflow port 61 is positioned at the lowest position in the ink flow path that is constituted in the flow path space 14, and is arranged at a lower position than the other liquid inflow ports (the second liquid inflow port 62 to the fourth liquid inflow port 64). Therefore, in a state in which the pigment component has settled, the first liquid inflow port 61 is positioned in the high-concentration ink layer 6 accumulated at the bottom part of the case 11.

Therefore, in the fourth embodiment, similarly to the first to third embodiments, high-concentration ink taken in from the first liquid inflow port 61 is reliably mixed with the pigment ink flowing toward the ink supply part 13. In addition, no low-concentration ink is taken in on the downstream side of the first liquid inflow port 61. Accordingly, it is possible to suppress variation in the concentration of the ink to be supplied to the inkjet head. It is also possible to avoid the occurrence of faulty image quality, ink nozzle clogging and the like due to high-concentration ink having a pigment concentration that exceeds the proper range being supplied from the ink supply part 13 to the inkjet head when the ink residual amount becomes low.

In addition, in the fourth embodiment, when manufacturing the case 11 provided with the ink reservoir chamber 17, the flow path space 14 can be integrally formed at the same time. Therefore, the ink tank 10 provided with the flow path space 14 is easily manufactured.

Other Embodiments

In the fourth embodiment, the partition walls 18 and 19 are provided in the ink tank 10 provided with the case 11 whose side surface is open, and the flexible film 12 that seals the opening of the case 11, thereby forming the flow path space 14, but configurations may be adopted in which the partition walls 18 and 19 are not provided, and the flow path members 4, 4A, and 4B of the first to third embodiments are arranged in the case 11. In this case, it is sufficient that the upper ends of the flow path members 4, 4A, and 4B are connected to the ink supply part 13. With such a configuration as well, actions and effects similar to those of the above embodiments are obtained.

What is claimed is:

1. A liquid storing body comprising:

a liquid storing part that is capable of storing a liquid containing a sedimentous component;

a liquid supply part that is positioned at an upper portion of the liquid storing part, and is capable of supplying the liquid from the liquid storing part to a liquid jetting apparatus; and a flow path that connects the liquid supply part and the interior of the liquid storing part, wherein the flow path includes a plurality of liquid inflow ports at a plurality of positions at different heights, the plurality of liquid inflow ports allowing the liquid to flow from the interior of the liquid storing part into the flow path, out of the plurality of liquid inflow ports, a first liquid inflow port positioned at a lowest position in the flow path is arranged on a downstream side of the other liquid inflow ports in a flow of the liquid toward the liquid supply part, the flow path includes a first flow path part extending in an up-down direction from the liquid supply part to a lowest position in the flow path, a second flow path part extending in a direction intersecting the first flow path part from a lower portion of the first flow path part, and a third flow path part extending upward from the second flow path part, and wherein each of the plurality of liquid inflow ports arranged at the different heights, other than the first liquid inflow port, are located in the third flow path part.

2. The liquid storing body according to claim 1, wherein the first flow path part extends to a position lower than a position that intersects the second flow path part.

3. The liquid storing body according to claim 2, wherein the third flow path part includes a plurality of flow paths extending upward from the second flow path part, and upper ends of the plurality of flow paths are positioned at different heights, and the liquid inflow ports are respectively provided at the upper ends of the plurality of flow paths.

4. The liquid storing body according to claim 1, further comprising:

a case in which a recess that constitutes the liquid storing part and the flow path is formed; and a film that seals an opening of the recess, wherein the liquid storing part and the flow path are partitioned by a partition wall arranged in the recess.

5. The liquid storing body according to claim 1, wherein the liquid storing part is a bag.

6. The liquid storing body according to claim 1, wherein the first liquid inflow port is open to the liquid and faces a bottom of the liquid storing part.

7. The liquid storing body according to claim 6, wherein the first liquid inflow port is coaxially arranged with the first flow path part.

* * * * *